US005962145A

United States Patent [19]

Matsukawa

[11] Patent Number: 5,962,145

[45] Date of Patent: Oct. 5, 1999

[54] ALUMINUM SURFACE TREATMENT AGENT, TREATMENT METHOD, AND TREATED ALUMINUM

[75] Inventor: Masahiko Matsukawa, Suita, Japan

[73] Assignee: Nippon Paint Co., Ltd., Osaka, Japan

[21] Appl. No.: 08/869,771

[22] Filed: Jun. 5, 1997

[30] Foreign Application Priority Data

Jun. 14, 1996 [JP] Japan ..... 8-153577

[51] Int. Cl.[6] ..... B32B 15/08; B32B 9/00; B05D 1/32; C04B 9/02

[52] U.S. Cl. ..... 428/461; 428/469; 428/472; 428/457; 427/447; 106/14.05; 106/14.44

[58] Field of Search ..... 428/621, 624, 428/626, 650, 457, 469, 472, 461; 427/421, 447, 388.4; 198/247, 251, 275; 106/14.21, 14.44, 14.05

[56] References Cited

U.S. PATENT DOCUMENTS

| | | | |
|---|---|---|---|
| 4,624,795 | 11/1986 | Dawson et al. | 252/8.553 |
| 4,954,372 | 9/1990 | Sako et al. | 427/388.2 |
| 4,963,596 | 10/1990 | Lindert et al. | 526/313 |
| 4,978,399 | 12/1990 | Kodama et al. | 148/250 |
| 5,089,064 | 2/1992 | Reghi | 148/247 |

FOREIGN PATENT DOCUMENTS

| | | |
|---|---|---|
| 0 008 942 | 3/1980 | European Pat. Off. . |
| 2 255 393 | 7/1975 | France . |
| 39 00 149 A1 | 7/1989 | Germany . |
| 59-205595 | 11/1984 | Japan . |
| A-1-208477 | 8/1989 | Japan . |
| A-4-263083 | 9/1992 | Japan . |
| A-4-366182 | 12/1992 | Japan . |
| A-6-172777 | 6/1994 | Japan . |
| A-7-197273 | 8/1995 | Japan . |
| WO 85/05131 | 11/1985 | WIPO . |
| WO 95/14539 | 6/1995 | WIPO . |

OTHER PUBLICATIONS

Patent Abstracts of Japan, JP 59–205595; Nov. 21, 1984.

*Primary Examiner*—Paul Thibodeau
*Assistant Examiner*—Holly C. Rickman
*Attorney, Agent, or Firm*—Oliff & Berridge, PLC

[57] ABSTRACT

An aluminum surface treatment method is provided for forming a film having anticorrosion properties and, in particular, antirusting properties by treating aluminum or an aluminum alloy using an aluminum surface treatment agent comprising a fluoromental acid or fluoromental acid salt including at least one of the metals zirconium, titanium hafnium, aluminum, silicon, germanium, tin, or boron, and at least one type of polymer compound comprising a homopolymer or a copolymer of an aromatic sulfonic acid monomer containing unsaturated bonds or an aliphatic sulfonic acid monomer containing unsaturated bonds. Also provided are aluminum or an aluminum alloy on which this film is formed.

21 Claims, No Drawings

ALUMINUM SURFACE TREATMENT AGENT, TREATMENT METHOD, AND TREATED ALUMINUM

BACKGROUND OF THE INVENTION

1. Field of the Invention

This invention relates to an aluminum surface treatment agent, a treatment method, and to treated aluminum, and in particular, to an aluminum surface treatment agent having excellent anticorrosion properties.

2. Description of the Related Arts

Aluminum and aluminum alloys are widely used in heat exchangers because they are lightweight and have excellent workability and thermal conductivity. Today, air conditioning systems are a commonplace feature of everyday life, and the use of such systems for cooling, dehumidifying and dual function cooling and heating is increasing. The heat exchanger parts of these devices generally employ fins made of aluminum alloy.

When an air conditioner is used for cooling, moisture present in the air tends to accumulate as condensation on the fin surfaces. The fin surfaces may be made water repellent to counteract this, but this may result in water adhering as hemispherical drops spanning the spaces between fins, interfering with air intake and increasing resistance to air flow. This decreases heat exchange efficiency.

Aluminum and its alloys normally have excellent anticorrosion properties. However, condensation accumulating on fin surfaces for long periods of time may form oxygen concentration cells, while pollutants in the atmosphere gradually build up and concentrate leading to hydration reactions and corrosion. The corrosion products which may accumulate on the fin surfaces not only impair heat exchange properties, but in winter, when the devices are used for heating, they form a fine white powder which is discharged together along with warm air.

Conventionally, surface treatment agents containing chromium were used to maximize the corrosion resistance of aluminum surfaces, however as these chromium-containing agents present an environmental pollution risk, it has become common in recent years to use non-chromate surface agents. However, the anticorrosion properties of these non-chromate type agents are somewhat inferior to those of chromium-containing agents, and therefore non-chromate type surface treatment agents incorporating various improvements have been proposed.

For example, in the "Aluminum Non-Chromate Surface Treatment Agent and Treatment Method" described in U.S. Pat. No. 5,089,064, an acidic agent is proposed comprising water and (A) 0.8–1.2 (w/o) $H_2ZrF_6$ (known as dihydrohexafluorozirconate or fluorozirconic acid), (B) 0.08–0.12 (w/o) dispersed silica, (C) 0.08–0.12 (w/o) water-soluble or water-dispersible 3-(N-methyl-N-2-hydroxyethylaminomethyl)-4-hydroxystyrene polymer, and (D) 0.10–0.15 (w/o) 1-propoxy-2-propanol.

In the "Metal Treatment Composition and Treatment Method" described in WO 9514539, a metal treatment composition is proposed comprising (A) $H_2TiF_6$, $H_2ZrF_6$, $H_2HtF_6$, $H_2AlF_6$, $H_2SiF_6$, $H_2GeF_6$, $H_2SnF_6$, $HBF_6$, (B) a water-soluble organocarboxylic acid comprising at least two OH groups (excluding the OH groups in COOH), and, if necessary, possibly further comprising (C) the elements Ti, Zr, Hf, Al, Si, Ge, Sn, B, or their oxides, hydroxides or carbonates, or (D) x—(N—$R_1$—N—$R_2$—aminomethyl)—4—hydroxystyrene (x=2,4,5 or 6, $R_1$=an alkyl group with $C_{1-4}$, $R_2$=a substituent group corresponding to $H(CHOH)_n$ $CH_2$—where n=1–7.

However, both the aluminum non-chromate surface treatment agent and treatment method disclosed in the above U.S. Pat. No. 5,089,064 and the metal treatment composition and treatment method disclosed in the above WO 9514539 fail to completely meet the aforesaid corrosion resistance requirements.

SUMMARY OF THE INVENTION

It is therefore an object of this invention, which was conceived in view of the problems in the aforesaid related art, to provide an aluminum surface treatment agent capable of forming a film having excellent anticorrosion and, particularly, antirusting properties and a corresponding treatment method, and to provide a treated aluminum or treated aluminum alloy obtained by using this aluminum surface treatment agent.

To achieve the above objectives, the aluminum surface treatment agent according to this invention comprises a fluorometal acid or salt comprising at least one of the metals selected from zirconium, titanium, hafnium, aluminum, silicon, germanium, tin or boron, and at least one type of polymer compound comprising a homopolymer or a copolymer of an aromatic sulfonic acid monomer containing unsaturated bonds or an aliphatic sulfonic acid monomer containing unsaturated bonds.

The aluminum surface treatment method according to this invention is a method wherein a film is formed by treating aluminum or aluminum alloy with the aforesaid aluminum surface treatment agent.

The aluminum or aluminum alloy according to this invention is aluminum or aluminum alloy on which a film has been formed comprising the aforesaid aluminum surface treatment agent.

Both aluminum and aluminum alloy on which a film has been formed by the aforesaid aluminum surface treatment agent have improved anticorrosion properties and, in particular, antirusting, properties. This is due to the fact that a finer chemical-conversion film can be formed by including at least one type of polymer compound comprising a homopolymer or a copolymer comprising an aromatic sulfonic acid monomer containing unsaturated bonds or an aliphatic sulfonic acid monomer containing unsaturated bonds.

The aluminum surface treatment agent according to this invention comprises a fluorometal acid or fluorometal acid salt comprising at least one of the metals selected from zirconium (Zr), titanium (Ti), hafnium (Hi), aluminum (Al), silicon (Si), germanium (Ge), tin (Sn), or boron (B), and at least one type of polymer compound comprising a homopolymer or a copolymer of an aromatic sulfonic acid monomer containing unsaturated bonds or an aliphatic sulfonic acid monomer containing unsaturated bonds.

Examples of fluorometal acids containing at least one of the metals selected from zirconium, titanium, hafnium, aluminum, silicon, germanium, tin, or boron, are $H_2ZrF_6$, $H2TiF_6$, $H_2HfF6$, $H_2AlF_6$, $H_{2S}iF_6$, $H_2GeF_6$, $H_2SnF6$ and $HBF_6$. Examples of fluoromental acid salts are alkali metal salts such as sodium salt, potassium salt, lithium salt, or ammonium salt.

In the polymer compound or compounds comprising a homopolymer or a copolymer of an aromatic sulfonic acid monomer containing unsaturated bonds or an aliphatic sulfonic acid monomer containing unsaturated bonds, examples of aromatic sulfonic acid monomers containing unsaturated bonds are styrene sulfonic acid represented by the following formula (I) and its salts, and examples of aliphatic sulfonic acid monomers containing unsaturated bonds are vinyl sulfonic acid represented by the following formula (II) and its salts.

(I)

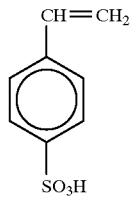

(II)

$$CH_2{=}CH{-}SO_3H$$

The aforesaid polymer compound may therefore conveniently be polystyrene sulfonic acid and its salts. The number average molecular weight of polystyrene sulfonic acid (referred to hereafter as PSS) is preferably 500–10,000,000 but more preferably 8,000–200,000. When the molecular weight of PSS is less than 500, a film having excellent anticorrosion properties cannot be formed. On the other hand when the molecular weight of PSS exceeds 10,000,000, the viscosity of the aluminum surface treatment agent increases, surface treatment becomes uneven and anticorrosion properties again decline. Examples of PSS salts are alkali metal salts such as sodium salt, potassium salt, lithium salt, and ammonium salt.

The aluminum surface treatment agent according to this invention preferably comprises 10–10,000 ppm, and more preferably 100–5,000 ppm, of a fluorometal acid or fluorometal acid salt comprising at least one of the metals zirconium, titanium, hafnium, aluminum, silicon, germanium, tin, or boron. When the amount of fluorometal acid or fluorometal acid salt is less than 10 ppm, extremely little aluminum etching reaction occurs, and, as the film formation rate due to zirconium, etc. considerably declines, no film forms. On the other hand when the amount of fluorometal acid or fluorometal acid salt exceeds 10,000 ppm, the aluminum etching rate becomes greater than the film forming rate, so the film does not form easily. Moreover the effect of adding zirconium, etc. is not much enhanced and there is little economic advantage.

The aluminum surface treatment agent according to this invention preferably comprises 1–100,000 ppm, but more preferably 10–5,000 ppm, of a homopolymcr or a copolymer of an aromatic sulfonic acid monomer containing unsaturated bonds or an aliphatic sultonic acid monomer containing unsaturated bonds. When the amount of PSS is less than 1 ppm, no improvement of anticorrosion properties is obtained. On the other hand, when the amount of PSS exceeds 100,000 ppm, the effect obtained is not concomitant with the increased addition amount and this amount is therefore not economical.

In the aluminum surface treatment method according to this invention, the pH of the above aluminum surface treatment agent is preferably about 1.5–5.5, but more preferably 2.5–4.5. pH may be adjusted by NaOH, aqueous ammonia, nitric acid or the like. The treatment temperature of the aluminum surface treatment agent, aluminum or aluminum alloy is preferably about 30–80° C., but more preferably 40–60° C. When the agent is spray coated on the aluminum or aluminum alloy, the spraying time is preferably approx. 3 seconds–600 seconds, but more preferably 30–60 seconds. The agent may also be brought in contact with the aluminum or aluminum alloy through dipping, flow coating, or roll coating. Degreasing may be performed as a prior step to surface treatment (e.g. chemical-conversion treatment). The degreasing may be acid degreasing using sulfuric acid or nitric acid, solvent degreasing using trichloroethylene, perchloroethylene, gasoline or n-hexane, or alkali degreasing using sodium hydroxide, sodium carbonate, sodium silicate or sodium phosphate. The aluminum or aluminum alloy which has been chemically treated as described hereabovc is then subjected to a drying step, through it may be washed with water before drying.

The treated aluminum or aluminum alloy according to this invention may be obtained by using the above aluminum surface treatment agent in the above treatment method.

DESCRIPTION OF ACTUAL EXAMPLES

Next, this invention will be described in more detail with reference to specific and comparative examples, through it is to be understood that the invention is in no way limited to these examples.

Examples 1–16 and Comparative Example 1

(1) Treated object: Al-Mn type (JIS-A3004) aluminum alloy plate (2) Undercoat film test method:

Salt Spray Test (SST):

An object was placed in a sealed box containing 5% brine mist while maintaining the temperature at 35° C. It was then removed after a given time, and the general rusting of the object was examined. When the occurrence of white rust was no greater than 10% (% area), it was determined that the object could be used without any problem.

(3) Treatment conditions:

After spraying an Al-Mn type (JIS-A3004) aluminum alloy plate with an acidic degreasing agent ("Surfcleaner NHC250", NIPPON PAINT CO., LTD.) having a concentration of 30g/l at 75° C. for 60 seconds, the object was washed with water, spray-treated with an aluminum surface treatment agent having the composition shown in Table 1 at pH 4.0 and 50° C. for 20 seconds, washed with water, and then dried at 190° C. for 2 minutes. The test results are shown in Table 1.

TABLE 1

| | Composition of Aluminum Surface Treatment Agent | | | | | | | Treatment Condition | | Test Results Salt Spray |
|---|---|---|---|---|---|---|---|---|---|---|
| | Fluoro-zirconium salt | Concentration of fluorozirconium salt (ppm) | Polystyrene sulfonic acid salt | Number Molecular weight of Polystyrene sulfonic acid salt | Concentration of Polystyrene sulfonic acid salt (ppm) | Acid | pH | Treatment temperature (°C.) | Treatment time (second) | Test (SST) (White rust % area) |
| Example | | | | | | | | | | |
| 1 | $NH_4$ | 450 | $NH_4$ | 100,000 | 1,000 | — | 4.5 | 60 | 50 | 5 |
| 2 | $NH_4$ | 450 | $NH_4$ | 1,000 | 1,000 | — | 4.5 | 60 | 50 | 5 |
| 3 | $NH_4$ | 450 | $NH_4$ | 10,000,000 | 1,000 | — | 4.5 | 60 | 50 | 5 |
| 4 | $NH_4$ | 450 | $NH_4$ | 100,000 | 1,000 | $H_2SO_4$ | 3 | 60 | 50 | 2 |
| 5 | K | 450 | $NH_4$ | 100,000 | 1,000 | $H_2SO_4$ | 3 | 60 | 50 | 2 |
| 6 | Na | 450 | $NH_4$ | 100,000 | 1,000 | $H_2SO_4$ | 3 | 60 | 50 | 2 |
| 7 | $NH_4$ | 450 | K | 100,000 | 1,000 | $H_2SO_4$ | 3 | 60 | 50 | 3 |
| 8 | $NH_4$ | 450 | Na | 100,000 | 1,000 | $H_2So_4$ | 3 | 60 | 50 | 3 |
| 9 | $NH_4$ | 450 | Li | 100,000 | 1,000 | $H_2SO_4$ | 3 | 60 | 50 | 3 |
| 10 | $NH_4$ | 450 | $NH_4$ | 100,000 | 10 | $H_2SO_4$ | 3 | 60 | 50 | 5 |
| 11 | $NH_4$ | 450 | $NH_4$ | 100,000 | 10,000 | $H_2SO_4$ | 3 | 60 | 50 | 2 |
| 12 | $NH_4$ | 450 | $NH_4$ | 100,000 | 1,000 | $H_2SO_4$ | 3 | 60 | 120 | 2 |
| 13 | $NH_4$ | 4500 | $NH_4$ | 100,000 | 1,000 | $H_2SO_4$ | 3 | 40 | 30 | 5 |
| 14 | $NH_4$ | 450 | $NH_4$ | 100,000 | 1,000 | $H_2SO_4$ | 2.5 | 50 | 50 | 3 |
| 15 | $NH_4$ | 4500 | $NH_4$ | 100,000 | 1,000 | $H_2SO_4$ | 4 | 60 | 50 | 5 |
| 16 | $NH_4$ | 450 | $NH_4$ | 100,000 | 1,000 | $HNO_3$ | 3 | 60 | 50 | 2 |
| Comparison Example 1 | $NH_4$ | 450 | — | — | — | — | 4.5 | 60 | 50 | 30 |

N.B. Acid is used to adjust pH.

From these results, it was found that anticorrosion properties (white rust % area) were improved by the aluminum surface treatment agent according to this invention as compared to the treatment agents of the related art.

Therefore, by using the aluminum surface treatment agent and treatment method according to this invention, a film having excellent anticorrosion properties and, in particular, antirusting properties is formed. Moreover, since aluminum or aluminum alloy which has been surface treated using the aluminum surface treatment agent according to this invention has superior anticorrosion properties and in particular antirusting properties, it may for example be used for heat exchanger fins in air conditioners or the like.

What is claimed:

1. An aluminum surface treatment agent comprising:

a fluorometal acid or fluorometal acid salt comprising at least one metal selected from the group consisting of zirconium, titanium, hafnium, aluminum, silicon, germanium, tin, and boron, and polymer compound consisting essentially of a homopolymer of polystyrene sulfonic acid or one of its salts.

2. An aluminum surface treatment agent as defined in claim 1, wherein the pH of said aluminum surface treatment agent is 1.5–5.5.

3. An aluminum surface treatment agent as defined in claim 1, wherein the pH of said aluminum surface treatment agent is 2.5–4.5.

4. An aluminum surface treatment agent as defined in claim 1, wherein the amount of said fluorometal acid or fluorometal acid salt is 10–10,000 ppm.

5. An aluminum surface treatment agent as defined in claim 1, wherein the amount of said flourometal acid or fluorometal acid salt is 100–5,000 ppm.

6. An aluminum surface treatment agent as defined in claim 1, wherein said flourometal acid or fluorometal acid salt is either an ammonium salt, or at least one type of alkali metal salt selected from the group consisting of sodium salt, potassium salt, and lithium salt.

7. An aluminum surface treatment agent as defined in claim 1, wherein the number average molecular weight of said polymer compound is 500–10,000,000.

8. An aluminum surface treatment agent as defined in claim 1, wherein the number average molecular weight of said polymer compound is 8,000–200,000.

9. An aluminum surface treatment agent as defined in claim 1, wherein the amount of said polymer compound contained therein is 1–100,000 ppm.

10. An aluminum surface treatment agent as defined in claim 1, wherein the amount of said polymer compound contained therein is 10–50,000 ppm.

11. An aluminum surface treatment agent as defined in claim 1, wherein said polymer compound is polystyrene sulfonic acid, its ammonium salt, or at least one of its alkali metal salts selected from the group consisting of sodium salt, potassium salt, and lithium salt.

12. An aluminum surface treatment agent characterized in comprising:

at least one fluorozirconium salt selected from the group consisting of ammonium salt, potassium salt, and sodium salt of fluorozirconium acid, and a polymer compound consisting essentially of a homopolymer of polystyrene sulfonic acid salt selected from the group consisting of ammonium salt, potassium salt, and sodium salt of polystyrene sulfonic acid.

13. An aluminum surface treatment agent comprising:

100–5,000 ppm of at least one fluorozirconium salt selected from the group consisting of ammonium salt, potassium salt, and sodium salt of fluorozirconium acid; and 1–100,000 ppm of a polymer compound consisting essentially of a homopolymer of polystyrene sulfonic acid salt selected from the group consisting of ammonium salt, potassium salt, and sodium salt of polystyrene sulfonic acid of number average molecular weight 500–1,000,000, wherein the pH of said agent is 2.5–4.5.

14. An aluminum surface treatment method characterized in that aluminum or an aluminum alloy is treated by an aluminum surface treatment agent comprising:

a fluorometal acid or fluorometal acid salt comprising at least one metal selected from the group consisting of zirconium, titanium, hafnium, aluminum, silicon, germanium, tin, and boron, and a polymer compound consisting essentially of a homopolymer of polystyrene sulfonic acid or one of its salts.

15. An aluminum surface treatment method as defined in claim 14, wherein said aluminum surface treatment agent is brought in contact with said aluminum or aluminum alloy at a treatment temperature of 30–80° C.

16. An aluminum surface treatment method as defined in claim 14, wherein said aluminum surface treatment agent is brought in contact with said aluminum or aluminum alloy at a treatment temperature of from 40–60° C.

17. An aluminum surface treatment method as defined in claim 14, wherein said aluminum surface treatment agent is spray coated on said aluminum or aluminum alloy for approximately 3 seconds–600 seconds.

18. An aluminum surface treatment method as defined in claim 14, wherein said aluminum surface treatment agent is spray coated on said aluminum or aluminum alloy for approximately 30 seconds–60 seconds.

19. An aluminum surface treatment method characterized in that the pH of an aluminum surface treatment agent comprising:

100–5,000 ppm of at least one fluorozirconium salt selected from the group consisting of ammonium salt, potassium salt, and sodium salt of fluorozirconium acid, and 1–100,000 ppm of a polymer compound consisting essentially of a homopolymer of polystyrene sulfonic acid selected from the group consisting of ammonium salt, potassium salt and sodium salt of polystyrene sulfonic acid of number average molecular weight 500–1,000,000, is adjusted to 2.5–4.5, and the agent is spray coated at a treatment temperature of 40–60° C. for approximately 3 seconds–600 seconds.

20. Aluminum or an aluminum alloy on which a film is formed using an aluminum surface treatment agent comprising:

a fluorometal acid or fluorometal acid salt comprising at least one metal selected from the group consisting of zirconium, titanium, hafnium, aluminum, silicon, germanium, tin, and boron, and a polymer compound consisting essentially of a homopolymer of polystyrene sulfonic acid or one of its salts.

21. Alumium or an aluminum alloy on which a film is formed using an aluminum surface treatment agent comprising:

100–5,000 ppm of at least one fluorozirconium salt selected from the group consisting of ammonium salt, potassium salt, and sodium salt of fluorozirconium acid, and 1–100,000 ppm of a polymer compound consisting essentially of a homopolymer of polystyrene sulfonic acid salt selected from the group consisting of ammonium salt, potassium salt, and sodium salt of polystyrene sulfonic acid of number average molecular weight 500–1,000,000;

wherein the pH of said agent is 2.5–4.5.

* * * * *